US005566058A

United States Patent [19]

Protz, Jr.

[11] Patent Number: 5,566,058

[45] Date of Patent: Oct. 15, 1996

[54] LIGHT CLIP FOR SHINGLES OR GUTTERS

[75] Inventor: William F. Protz, Jr., Lake Forest, Ill.

[73] Assignee: Santa's Best, Northfield, Ill.

[21] Appl. No.: 571,411

[22] Filed: Dec. 13, 1995

Related U.S. Application Data

[62] Division of Ser. No. 387,133, Feb. 9, 1995.

[51] Int. Cl.[6] ..... F21V 21/08

[52] U.S. Cl. ..... 362/396; 362/250; 362/285; 362/287; 362/430

[58] Field of Search ..... 362/396, 249, 362/250, 285, 287, 427, 430; 248/229, 316, 48.2, 221.4, 220.2, 74.2, 309.1

[56] References Cited

U.S. PATENT DOCUMENTS

| | | | |
|---|---|---|---|
| D. 317,115 | 5/1991 | Gary | D8/373 |
| D. 321,314 | 11/1991 | Gary | D8/373 |
| 3,584,795 | 6/1969 | Baird | 240/52 |
| 4,851,977 | 7/1989 | Gary | 362/249 |
| 5,141,192 | 8/1992 | Adams | 248/231.8 |

*Primary Examiner*—Denise L. Gromada
*Assistant Examiner*—Alfred Basichas
*Attorney, Agent, or Firm*—Emrich & Dithmar

[57] ABSTRACT

A light clip for holding a light bulb with an attachment portion for removably mounting the light clip to a support surface such as a shingle or gutter without putting holes in the gutters or shingles. The attachment portion has mechanism with a plurality of discrete stop positions, and cooperates with a bulb holder having connecting prongs. The mechanism with discrete stops cooperates with the prongs to mount the bulb holder to the attachment portion and to provide a plurality of discrete angular positions of a bulb carried by the bulb holder with respect to the attachment portion. The gutter attachment portion is capable of mounting onto a wide variety of gutter shapes.

6 Claims, 3 Drawing Sheets

LIGHT CLIP FOR SHINGLES OR GUTTERS

This is a divisional of application Ser. No. 08/387,133, filed Feb. 9, 1995.

BACKGROUND OF THE INVENTION

This invention relates to devices useful in supporting and displaying decorative lighting, and more particularly, to a device adapted to support a decorative light, such as a Christmas light. One aspect of the invention relates to a plastic or metal bracket that will support a decorative light and can be installed without screws, nails or other hardware which may pierce or otherwise impair gutters or roofs. Another aspect of invention relates to a mounting bracket or a device for decorative lighting and is in itself supported by frictional engagement with a support structure such as gutters or roof shingles and provides mechanism by which the decorative light may be positioned at different angles with respect to a roof or gutter or other support surface.

The use of decorative lighting for both commercial purposes and for residential purposes is well known. A major portion of exterior decorative lighting is seasonal in nature, such lighting being installed primarily during holiday periods and then removed after the holiday period has passed. Decorative lights are typically purchased as "strings" in which a large number of individual sockets are wired together, and bulbs, frequently colored, are inserted into each socket. Plugs are provided at one or both ends for connection to other light strings or to an electrical power source. Typically, at the Christmas season, there are bulbs which are of various sizes, for instance, mini bulbs and C-7 bulbs.

The present invention is directed to deficiencies that have been encountered with devices previously used to install and display exterior decorative lighting. In the past, exterior decorative lights have sometimes been installed by stapling light strings onto the eaves of fascia of a building. Stapling often leaves unattractive holes in the support surface when the decorative lighting and staples are removed. Moreover, the use of staples or the like also runs the risk of damaging the exterior coating on the power cords thereby possibly rendering the strings unsafe. Threaded hooks have also been used to support light strings in the past, but the hooks themselves are difficult to install, and did not secure the bulb sockets in a preferred orientation. One light bracket which does not mutilate or otherwise impair roofs, gutters or facia is disclosed Gary U.S. Pat. No. 4,851,977 issued Jul. 25, 1989. The device there disclosed installs between shingles on a roof and works for its intended purpose but lacks the versatility of the subject invention. Another device particularly adapted for gutters is illustrated in Adams U.S. Pat. 5,141,192, issued Aug. 25, 1992.

SUMMARY OF THE INVENTION

According to the present invention, a clip useful for displaying decorative lighting does not require the use of nails, threaded fasteners, or magnets in order to install such lighting on the exteriors of residences or commercial buildings. The clips disclosed herein permits quick and efficient installation of decorative lighting while enabling the installer to position the light bulbs at a variety of predetermined angles and have the bulbs maintained in a predetermined or selected orientation during the time that the bulbs are installed on the building. The clip disclosed herein is a two piece clip and is easily adapted to receive bulbs of various sizes, another important feature of the invention.

Accordingly, an important object of the invention is a two piece light clip which can be installed under the shingles of a roof without impairing the integrity of the shingles while permitting the bulbs to be angularly oriented with respect to the roof line at predetermined locations and at select angular positions.

Another object of the invention is to provide a two piece light clip which can be installed on gutters of various sizes and shapes attached to a roof without impairing the integrity of the gutters while permitting bulbs to be angularly oriented with respect to the roof line at predetermined locations and at selected annular positions.

Yet another object of the invention is to provide a two piece light clip of the type set forth which is mountable on a gutter and has not only mechanism for holding bulbs in various annular orientations but also a loop portion for holding strings or wires forming a wire set.

Still another object of the invention is to provide a two piece clip of the type set forth wherein light bulbs of various sizes and dimensions are easily accommodated.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
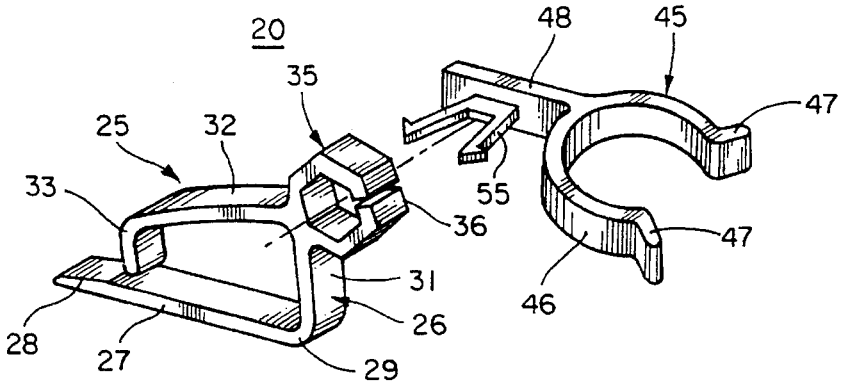
FIG. 1 is an exploded perspective view showing the two piece clip of the present invention.
Figure 2:
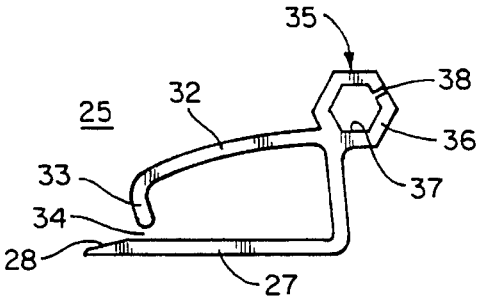
FIG. 2 is a side elevational view of the attachment portion of the two piece clip illustrated in FIG. 1.
Figure 3:
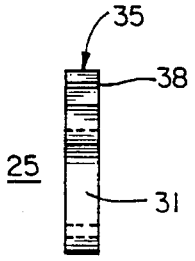
FIG. 3 is right side elevational view of the attachment portion of the two piece clip illustrated in FIG. 2.
Figure 4:
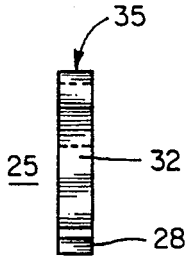
FIG. 4 is the left side elevational view of the attachment portion of the two piece clip illustrated in FIG.2.
Figure 5:
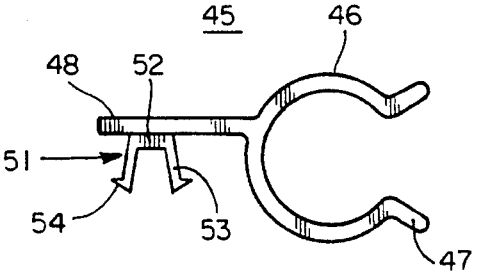
FIG. 5 is a top view of the bulb holder portion of the two piece light clip shown in FIG. 1.
Figure 6:
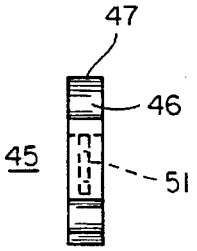
FIG. 6 is a right side elevational view of the bulb holder portion of the two piece bulb holder illustrated in FIG. 5.
Figure 7:
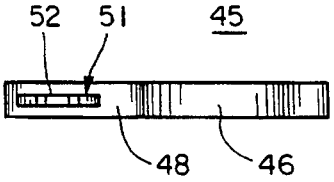
FIG. 7 is a bottom view of the bulb holder illustrated in FIG. 5.
Figure 8:
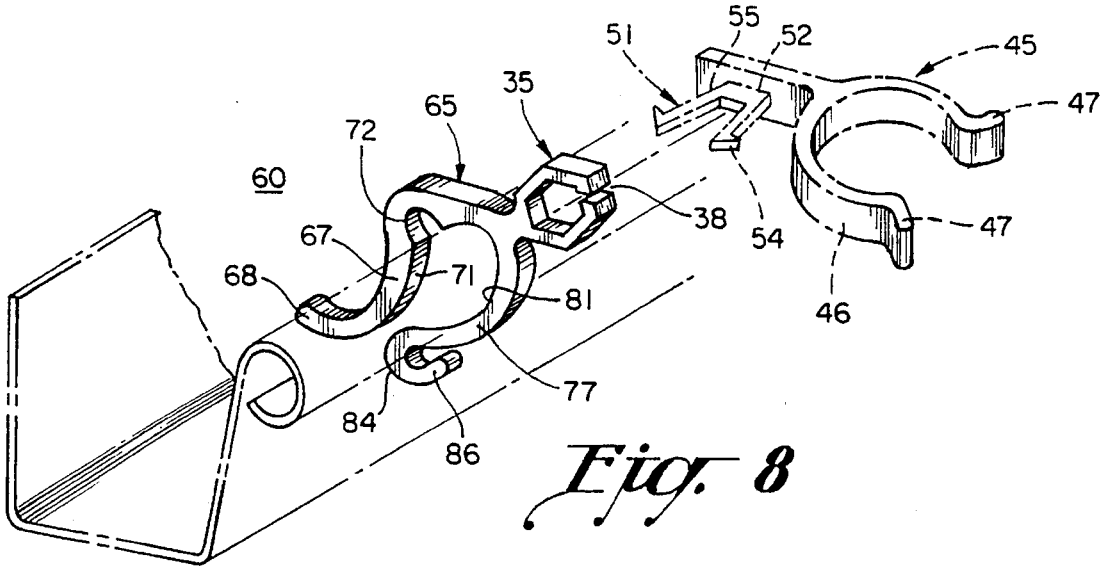
FIG. 8 is an exploded perspective view showing a two piece clip of the present invention adapted to fit over a gutter.

Referring to the drawings, there is illustrated in FIG. 1, a two piece light clip 20 including an attachment portion 25 and a bulb holder portion 45. The attachment portion 25 includes a body 26 which includes a flat portion 27 shown to extend horizontally as illustrated having a distal chamfered end 28 and a curved portion 29. The curved portion 29 integrally connects a vertical portion 31 with the flat portion 27. A sloping portion 32 is preferably integral with the vertical portion 31 and extends downwardly, to a vertically extending terminal portion 33 which ends just above the flat portion 27 near the chamfered end 28 thereof forming a space 34 between the end of the portion 33 and the top of the flat portion 27.

A positioning mechanism 35 is preferably but not necessarily integrally connected to the body 26 and includes a cylinder 36 having a longitudinal axis extending in a direction perpendicular to the vertical axis of portion 31. The cylinder 36 has internal surfaces 37 thereof forming a polygon in the plan perpendicular to the longitudinal axis (the dotted line in FIG. 1) of the cylinder 36. In FIG. 1, there is illustrated a hexagon such that there are six distinct internal surfaces 37, one of which has a slot 38 extending therethrough so as to provide resilience or flexibility to the cylinder 36.

The bulb holder portion 45 includes a part circular portion 46 which terminates into two outwardly extending portions 47 and is connected to a substantially straight stem portion 48 extending away from the circular portion 46. A connecting mechanism 51 is mounted at a base end 52 to the stem 48 and has a pair of fingers 53 extending angularly outwardly from the base 52, each of the fingers 53 ending in an outwardly extending locking mechanism 54 and having flat portions 55. Preferably, the connecting mechanism 51 is flexible so that the fingers 53 can be compressed together to fit within the cylinder 36 of the positioning mechanism 35 such that the flat portions 55 of the fingers 53 fit snugly against the flat inner surfaces 37 of the cylinder 36 to position the bulb holder portion 45 angularly with respect to the flat portion 27. It can be seen the bulb holder portion 45 may be moved in angular increments of 60 degrees that is 360 degrees divided by 6. If the cylinder 36 had the internal surfaces forming a octagon rather than a hexagon, then each incremental movement of the bulb holder portion 45 would be 45 degrees or 360 degrees divided by 8.

In use, the flat portion 27 of the attachment portion 25 is slid underneath a shingle of a roof thereby fictionally to mount the two piece light clip 20 to a roof. A bulb (not shown) which may be a C-7 bulb or a C-9 bulb or a mini bulb can be inserted into the bulb holder portion 45 and frictionally fit into the cylinder 36 by compression of the fingers 53 as previously described. When the compression on the fingers 53 is released, the material springs back to the position illustrated wherein the fingers 53 extend slightly away from each other and are wider than the distance between two flat interior surfaces 37 which are contacted by the fingers 53, thereby positioning the bulb holder 45 in the preferred angular position with respect to the roof.

Preferably, the material from which the two piece light clip 20 is constructed is a synthetic organic resin having some flexibility such as an acrylic or a polycarbonate, a polyvinyl chloride or a nylon. Flexibility is preferred both in the attachment portion 25 and in the bulb holder portion 45. In the attachment portion 25, the sloping portion 32 needs to be flexible and formed to urge the terminal end portion 33 towards the chamfered end 28 of the flat portion 27 thereby to engage the roof shingle firmly securing the two piece light clip 20 to the roof. The bulb holder portion 45 needs to be flexible or resilient so that the connecting mechanism 51 operates as indicated to contact the cylinder 36 and fixedly mount the bulb holder portion 45 in a desired angular configuration position.

Another feature of the invention is the easy accommodation of Christmas bulbs of various sizes. For instance, the invention easily accommodates C-7 or C-9 bulbs as well as miniature light bulbs or for that matter bulbs of any particular size. The only difference is in the size of the part circular portion 46 of the above holder portion 45. Moreover, if more than two or three sizes of bulbs are to be used then the invention is even more useful since inventions like that disclosed in the Gary '977 patent previously referenced cannot accommodate more than one or two size bulbs, whereas the present invention can accommodate a large number of different dimensioned bulbs all without structurally weakening the light clip 20 or any portion thereof.

Referring to FIGS. 8–15 there is disclosed another embodiment of the invention in the form of a two piece clip 60 having an attachment portion 65 in cooperation with the bulb holder portion 45 previously described. Because the bulb holder portion 45 in the two piece clip 60 is identical to and operates the same as the previously described bulb holder portion 45 in the two piece light clip 20, it will not be described again for purposes of brevity.

Figure 9:
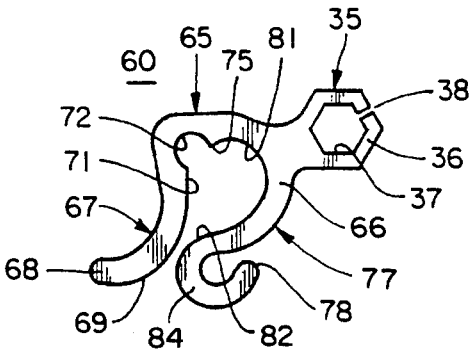
FIG. 9 is a side elevational view of the attachment portion of the two piece clip illustrated in FIG. 8.
Figure 10:
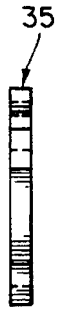
FIG. 10 is a right side elevational view of the attachment portion of the two piece clip illustrated in FIG. 9.
Figure 11:
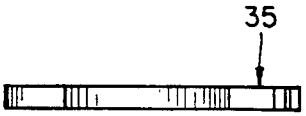
FIG. 11 is a top plan view of the attachment portion of a clip illustrated in FIG. 9.
Figure 12:
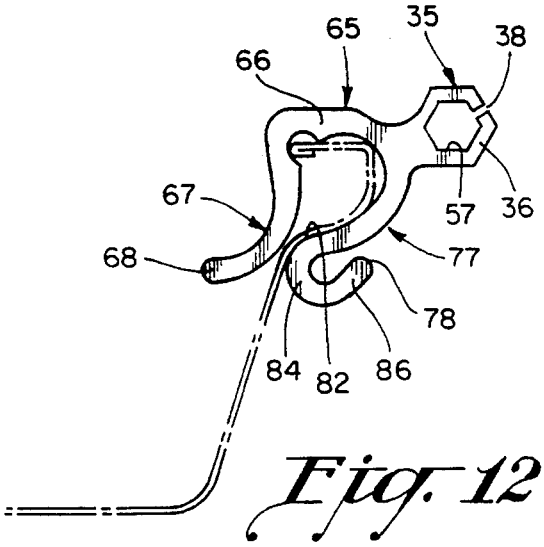
FIGS. 12–15 are side elevational views of the attachment portion of the clip illustrated in FIG. 8, shown mounted on a variety of commonly shaped gutters.
Figure 13:
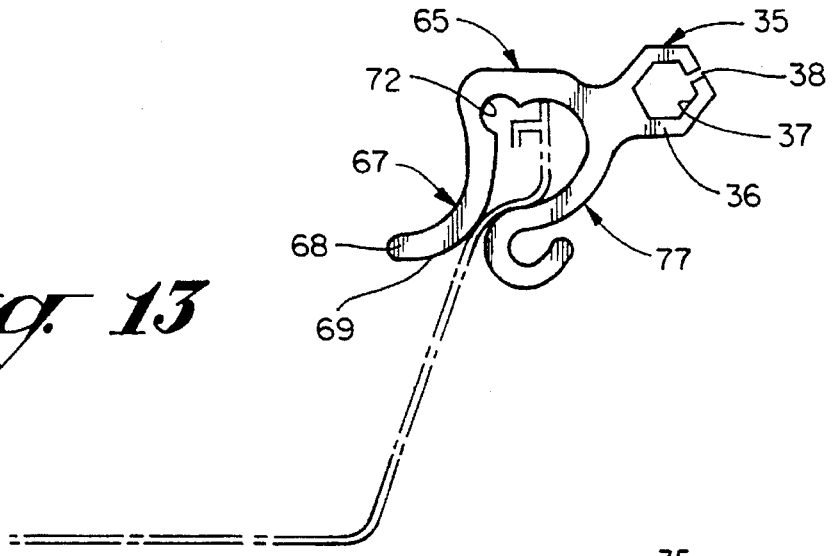
Figure 14:
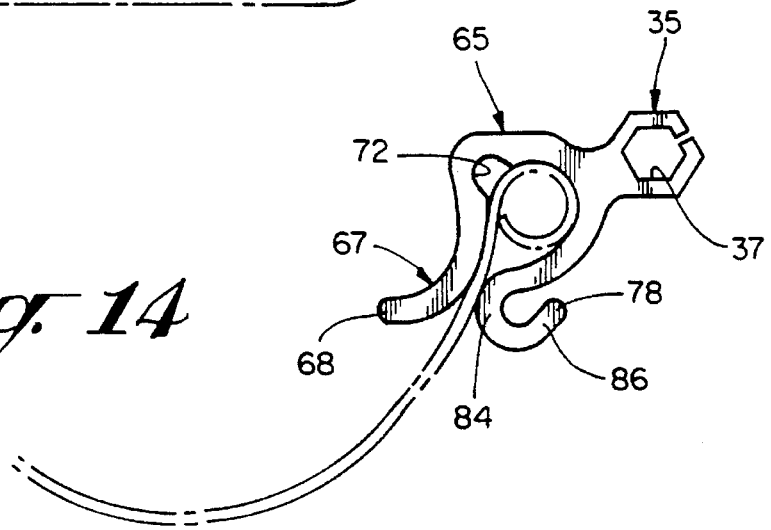
Figure 15:
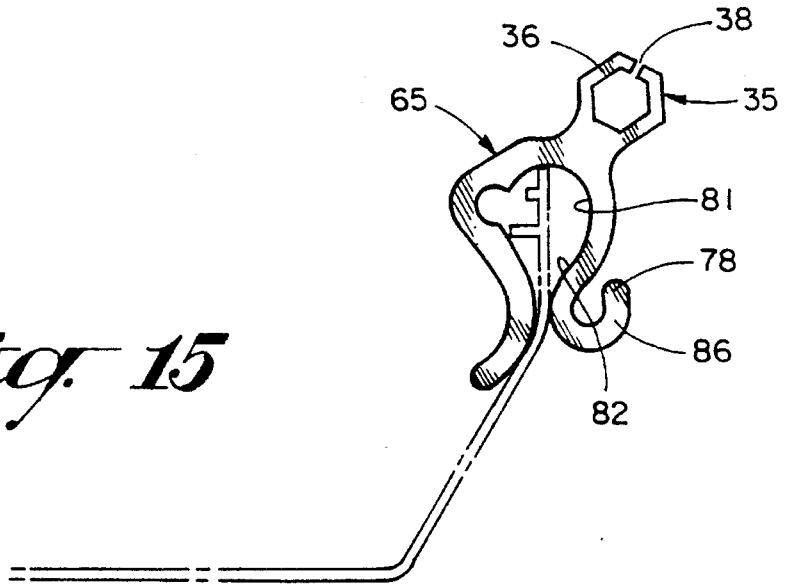

The attachment portion 65 is preferably a synthetic organic resin and it is a one piece construction, the resin which may be an acrylic, a polycarbonate, a nylon, a polyethylene or polypropylene or mixtures thereof is formed into a body portion 66 having a resilient finger 67 which is generally curved and has a distal end 68 and an inner contacting surface 69 near the distal end 68. Another inner contacting surface 71 is above the contacting surface 69 as seen in FIG. 9 and leads to a part arcuate inner surface 72. A nib 75 terminates the inner arcuate surfaces of the resilient finger 67.

Another resilient finger 77 is part of the body 66 and it has a distal end 78. The resilient finger 77 had an inner arcuate circular surface 81 beginning at the nib 75 and extending along the inner surface of the resilient finger 77 until it flattens out and is denoted by reference numeral 82. It should be understood that there is no necessarily clear distinction between the beginnings and ends of the inner surfaces ,59, 71, 72, 81 and 82. The inner surfaces are all part of the same general one piece construction 65 but are conveniently described for purposes hereinafter set forth.

The resilient finger 77 has a transition portion 84 where the direction of bend is changed to provide a reverse curved portion 86 which defines a hook for a purpose hereinafter described.

It is important that the two piece clip 60 is constructed to fit on a variety of different shaped gutters. Gutters as shown in FIGS. 8–15 come in a variety of configurations, all of which are illustrated with the exception of FIG. 8 in transverse cross section. It is important that the clip 60 and particularly the attachment portion 65 provide no less than 3 but preferably 5 and perhaps as many as 6 different contact areas between the associated gutter and the inside surface of the resilient fingers 67 and 77. The various inner contact surfaces previously described serve to provide a snug fit for the attachment portion 65 of the clip 60 on each of the various gutter configurations illustrated in the drawings particularly as shown in drawing FIGS. 12–15, inclusive. In each case, there are at least three distinct contact points. Moreover, the reverse curved portion 86 provides a hook on which may be hung a string of mini bulbs or a string of C-7 or C-9 sized Christmas bulbs in addition to those bulbs which are mounted onto the bulb holder portion 45 as described earlier with respect to the two piece light clip 20.

While there has been disclosed what is considered to be the preferred embodiment of the present invention, it is understood that various changes in the details may be made without departing from the spirit, or sacrificing any of the advantages of the present invention.

I claim:

1. A light clip for holding a Christmas light bulb onto a gutter, comprising: an attachment member having cooperating resilient fingers; one of said fingers having an arcuate portion resting inside an associated gutter contacting a portion of the gutter; one of said fingers having an arcuate portion contacting the outside of an associated gutter; said resilient fingers snugly and removably mounting said light clip to the associated gutter; a Christmas bulb holder having connecting mechanism thereon; and means carried by said attachment member having a plurality of discrete stops which cooperate with said connecting mechanism to provide a plurality of discrete angular positions of a bulb carried by said bulb holder.

2. The light clip of claim 1, wherein said one of said fingers contacting the outside of an associated gutter has a reverse curved portion defining a loop for accommodating a wire.

3. The light clip of claim 1, wherein said resilient fingers contact an associated gutter in at least four points of contact.

4. The light clip of claim 1, wherein said attachment member is a one piece synthetic organic resin having an arcuate inner surface for receiving an edge of an associated gutter.

5. The light clip of claim 1, wherein said attachment member is a one piece synthetic organic resin having a part circular arcuate inner surface for receiving a portion cylindrical bead of an associated gutter.

6. The light clip of claim 1, wherein said means includes a cylinder having a longitudinal axis forming a regular polygon perpendicular to the longitudinal axis of said cylinder having interior flat surfaces which cooperate with said means to provide said discrete stops.

* * * * *